US005809960A

United States Patent [19]

Hojyo et al.

[11] Patent Number: 5,809,960

[45] Date of Patent: Sep. 22, 1998

[54] INTAKE PIPE IN AN INTERNAL COMBUSTION ENGINE WITH CARBURETOR

[75] Inventors: Atuo Hojyo; Makoto Harada; Youichi Shihozawa, all of Saitama, Japan

[73] Assignee: Honda Giken Kogyo Kabushiki Kaisha, Tokyo, Japan

[21] Appl. No.: 905,947

[22] Filed: Aug. 5, 1997

[30] Foreign Application Priority Data

Aug. 5, 1996 [JP] Japan ..... 8-206236

[51] Int. Cl.[6] ..... F02M 35/10

[52] U.S. Cl. ..... 123/184.32; 123/184.46

[58] Field of Search ..... 123/184.32, 184.39, 123/184.46

[56] References Cited

U.S. PATENT DOCUMENTS 1,011,694 12/1911 Winton ..... 261/41.3
1,399,065 12/1921 Loomis ..... 261/1
4,153,015 5/1979 Hampton ..... 123/184.46
5,042,435 8/1991 Feuling ..... 123/579
5,076,218 12/1991 Graziadei ..... 123/73 V

*Primary Examiner*—David A. Okonsky
*Attorney, Agent, or Firm*—Birch, Stewart, Kolasch & Birch, LLP

[57] ABSTRACT

An intake pipe for absorbing vibrations of an internal combustion engine to prevent the transfer of the vibrations to a carburetor. The intake pipe includes an intake pipe body made of aluminum which is connected to an outlet portion of a carburetor. An intake pipe mounting flanges is made of aluminum and abuts with the intake inlets of intake ports formed respectively in front and rear cylinder heads of an overhead valve type, longitudinal V-shaped, two-cylinder, internal combustion engine. A coating member is made of rubber. The coating member covers the outer peripheral surface of the intake pipe body to combine the intake pipe body and the intake pipe mounting flanges with each other in an integral and airtight manner. The intake pipe body and the two intake pipe mounting flanges are formed as integral members.

10 Claims, 9 Drawing Sheets

INTAKE PIPE IN AN INTERNAL COMBUSTION ENGINE WITH CARBURETOR

BACKGROUND OF THE INVENTION

1. Field of the Invention

The present invention relates to an intake pipe for absorbing vibrations of an internal combustion engine equipped with a carburetor to prevent the vibrations from being transmitted to the carburetor.

2. Description of Background Art

In a conventional internal combustion engine with a carburetor there usually is employed an intake pipe constructed of the same material as that of a metallic cylinder head formed with an intake port. The carburetor is connected to an upstream end of the intake pipe, while the intake port formed in the cylinder head is connected to a downstream end of the intake pipe. Therefore, vibrations generated in the internal combustion engine are apt to be transmitted to the carburetor through the highly rigid intake pipe.

In a multi-cylinder internal combustion engine, especially a V-shaped internal combustion engine, equipped with a carburetor, the cylinder heads of the cylinders each sometime vibrate independently. In the case where a downstream portion of an intake pipe is connected at an upstream end to a single carburetor and is branched into plural intake pipes, vibrations of the cylinder head of one cylinder and that of the cylinder head of another cylinder are transferred to each other through the highly rigid intake pipes and are apt to interfere with each other.

In an effort to avoid such inconvenience there has been proposed an internal combustion engine in which an intake pipe is formed of a highly elastic material such as rubber. In such an internal combustion engine, vibrations are absorbed, but due to insufficient rigidity it is impossible to firmly support the weight of a carburetor or accommodate a negative intake pressure. This may make it impossible to retain a required shape for fresh air to flow smoothly. In addition, air cannot be fed in a uniformly dispersed state to each cylinder.

According to the present invention, an intake pipe for an internal combustion engine with a carburetor is provided which overcomes the above-mentioned problem. The intake pipe connects between an intake outlet of the carburetor and an intake inlet of an intake port in the internal combustion engine. A metallic intake pipe body is connected to the intake outlet of the carburetor and a metallic intake pipe mounting flange is brought into abutment with the intake inlet of the intake port in the internal combustion engine. The metallic intake pipe body and the metallic intake pipe mounting flange are separate members and are combined together in an airtight and integral manner using an elastic member which covers the outer peripheral surface of the metallic intake pipe body.

Since the present invention is constructed as above, even if the intake pipe is formed of a different material, an airtight structure is attained. The discharge of an air-fuel mixture into the atmosphere and the mixing of air contained in the atmosphere into the air fuel mixture which is set to a desired air-fuel ratio, are prevented.

In the present invention, since the intake pipe body is formed of a highly rigid metal, a required shape of an intake passage is ensured even when the intake pipe undergoes vibrations from the internal combustion engine or a negative intake pressure. Consequently, intake air can flow smoothly through the intake passage without causing disturbance and thus the intake pipe of the invention can contribute to maintaining the output and efficiency of the internal combustion engine at a high level.

In the present invention, moreover, since the metallic intake pipe body is combined integrally with the carburetor and the metallic intake pipe mounting flange is combined integrally with the internal combustion engine and are combined together using an elastic member, the transfer of vibrations from the internal combustion engine to the carburetor is prevented. The normal operation of the carburetor is ensured and the durability thereof is improved.

According to the present invention, vibrations of plural cylinders are prevented from being transferred to each other and an unfavorable influence on the carburetor and each cylinder caused by mutual interference of such vibrations is avoided.

According to the present invention vibrations of cylinders mounted separately in a crank case are prevented from being transferred to each other.

According to the present invention, at the time of start-up of the internal combustion engine or during operation at a low temperature, hot water can be introduced into the metallic intake pipe body to heat the body. It is possible to accelerate the vaporization of fuel in the air-fuel mixture to maintain the combustion in a stable state and improve the low temperature performance.

Further, according to the present invention, it is possible to further improve the air tightness of the intake system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
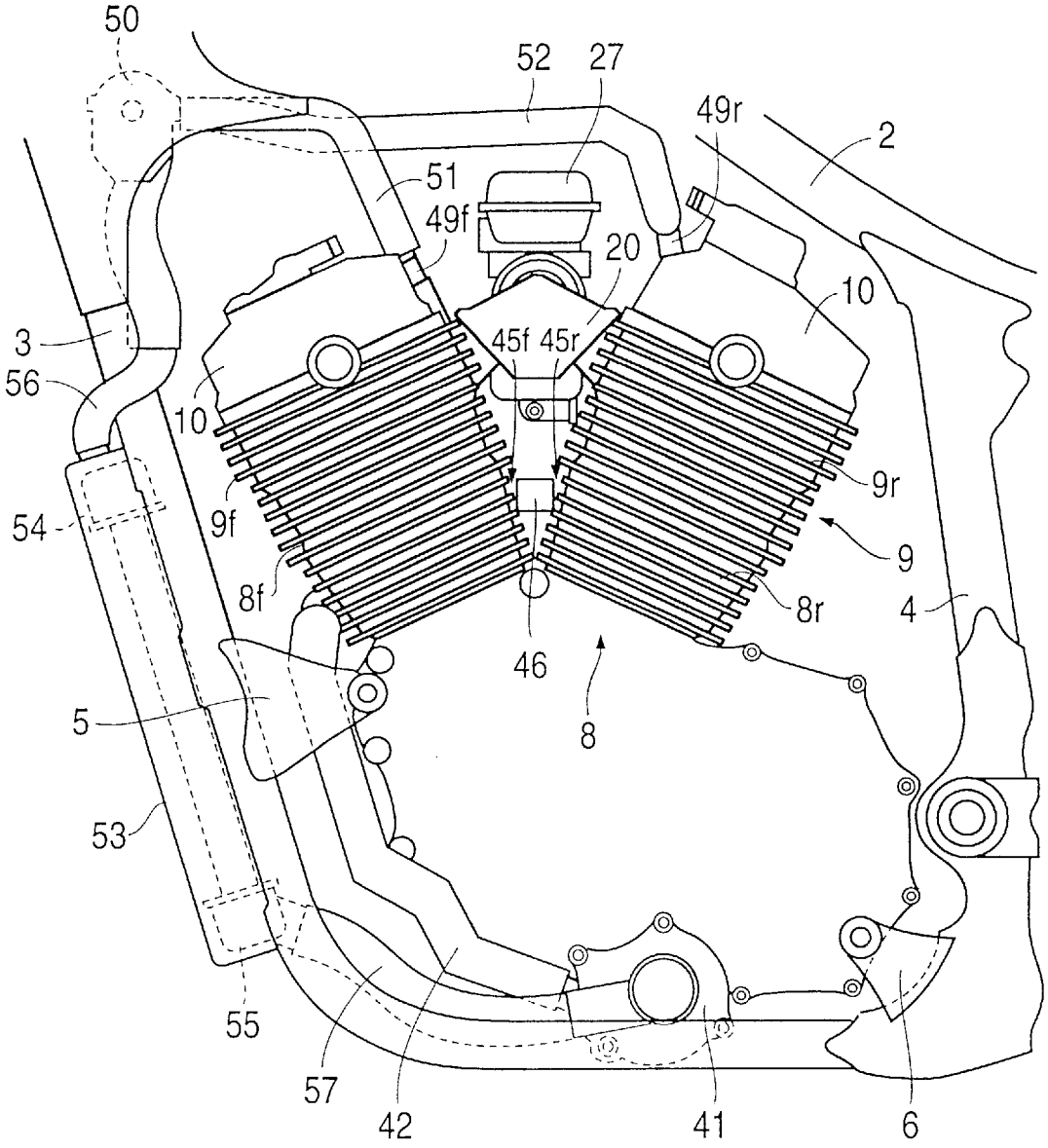
FIG. 1 is a side view of an internal combustion engine equipped with a carburetor and also equipped with an intake pipe structure embodying the present invention.

An embodiment corresponding to the invention is illustrated in FIGS. 1 to 10. An overhead valve type, longitudinal V-shaped, two cylinder 4-stroke, internal combustion engine 1 is mounted through brackets 5 and 6 on a down tube 3 and a center frame 4 suspended, respectively, from front and rear portions of a main frame 2 of a two-wheeled motor vehicle. In the internal combustion engine 1, a cylinder 8, including a front cylinder 8*f* and a rear cylinder 8*r*, and a cylinder head 9, including a front head 9*f* and a rear head 9*r*, are successively superposed together above a crank case 7 at a cylinder angle of about 52° and are combined together. The crank case 7, cylinders 8*f* and 8*r* and cylinder heads 9*f* and 9*r* are made of aluminum or an aluminum alloy, and the outer peripheral portion of a cylinder bore 11 of the cylinders 8*f* and 8*r* is made of cast iron. The upper portion of the cylinder heads 9*f* and 9*r* is covered with a head cover 10.

A piston 12 is inserted vertically slidably into the cylinder bore 11 of the cylinders 8*f* and 8*r*. The piston 12 and a crank shaft 14 extend in the transverse direction of the vehicle and are interconnected with a connecting rod 13. The crank shaft 14 is rotated with vertical movement of the piston 12.

An intake port 15 is branched right and left in a bifurcated shape at its downstream portion and is formed in the cylinder heads 9*f* and 9*r* at a position on the cylinder angle side of the cylinders 8*f* and 8*r*. At a position on the opposite side there is formed an exhaust port 16 in the cylinder heads 9*f* and 9*r*. To an upstream opening of the intake port 15 is secured an intake pipe mounting aluminum flange 22 of a bifurcated intake pipe 20 with bolts (not shown). A flange for mounting an exhaust pipe (not shown) is integrally fixed to a downstream opening of the exhaust port 16.

Further, an intake valve 18 and an exhaust valve 19 are disposed in the intake port 15 and the exhaust port 16, respectively, on the cylinder bore 11 side. A valve operating mechanism 30, for opening and closing the intake valve 18 and the exhaust valve 19, includes a cam shaft 32 which is supported rotatably by a cam shaft holder 31 in parallel with the crank shaft 14. A rocker arm 34 is supported pivotably by a rocker arm shaft 33 which is parallel to the cam shaft 32, a valve spring 35 urges the intake valve 18 and the exhaust valve 19 in their closed directions at all times. A driven sprocket 36 is integral with the cam shaft holder 31. A driving sprocket is integral with the crank shaft 14. An endless chain 37 is entrained on the driven sprocket 36. The cam shaft 32 is rotated at a speed which is half of the rotating speed of the crank shaft 14, whereby the intake valve 18 and the exhaust valve 19 are driven in an opening and closing motion at a timing of one rotation at every two rotations of the crank shaft 14.

Spark plugs 40 are disposed respectively in the vicinity of two intake valves 18.

Figure 3:
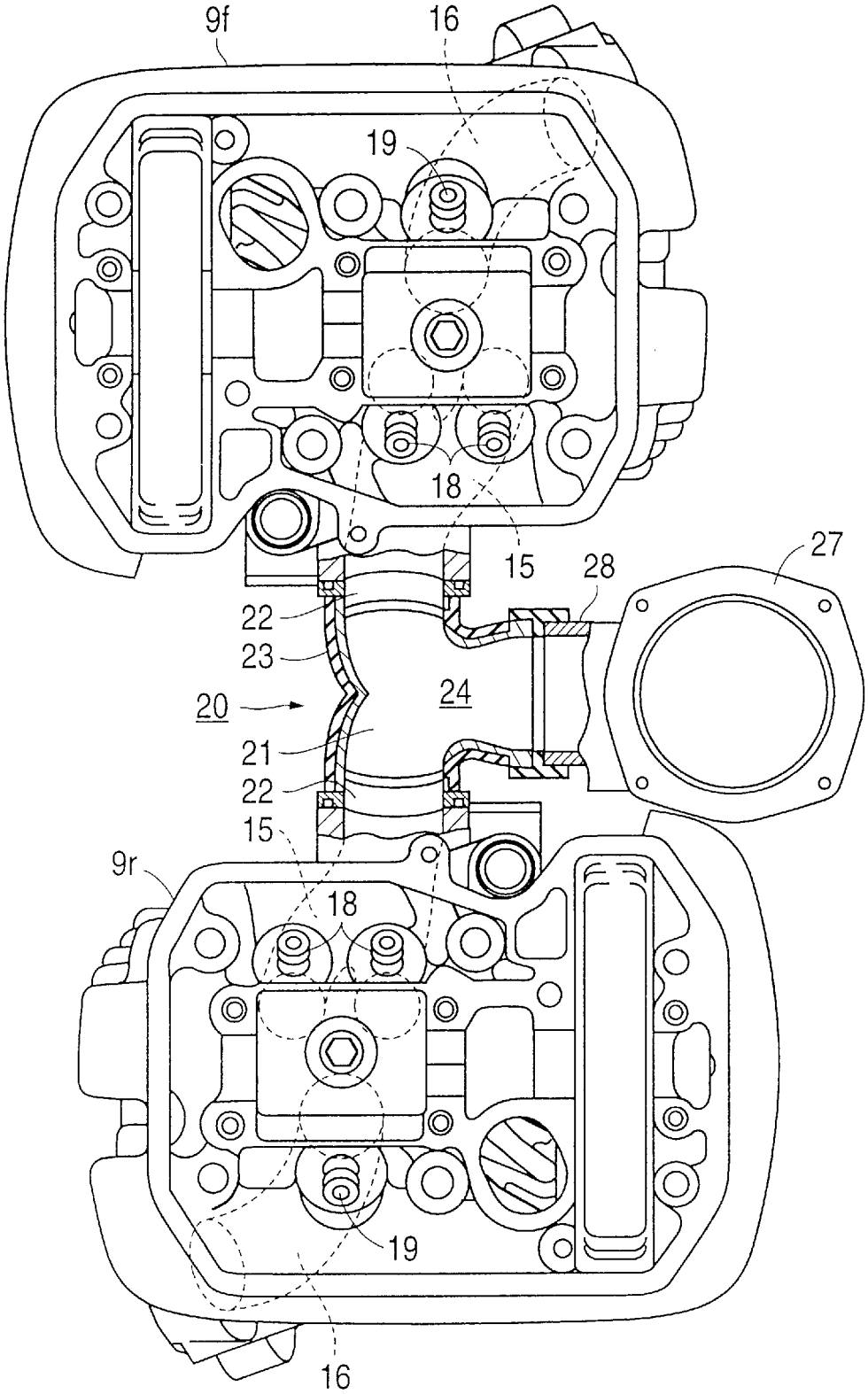
FIG. 3 is a plan view of the internal combustion engine illustrated in FIG. 1 with a head cover removed and the intake pipe shown in a partially cut-away state.
Figure 4:
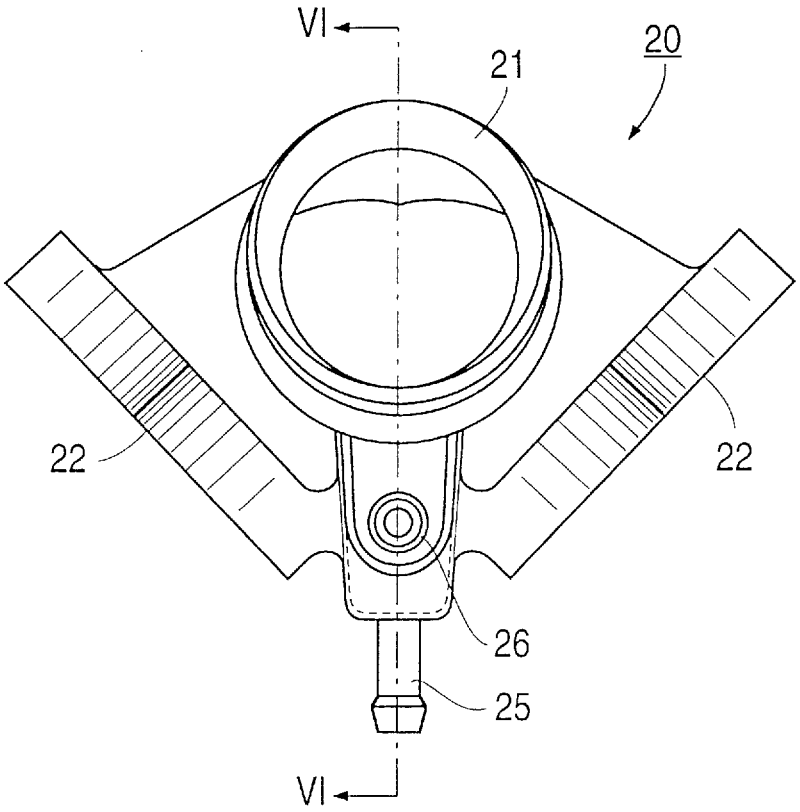
FIG. 4 is a front view of the intake pipe structure attached to the internal combustion engine shown in FIG. 1.
Figure 5:
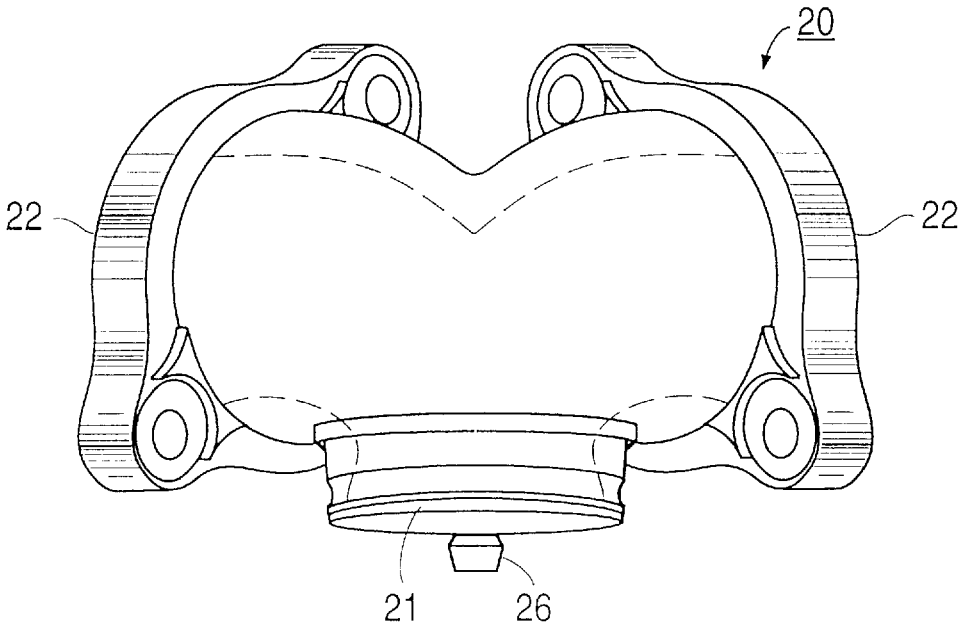
FIG. 5 is a plan view of FIG. 4.
Figure 6:
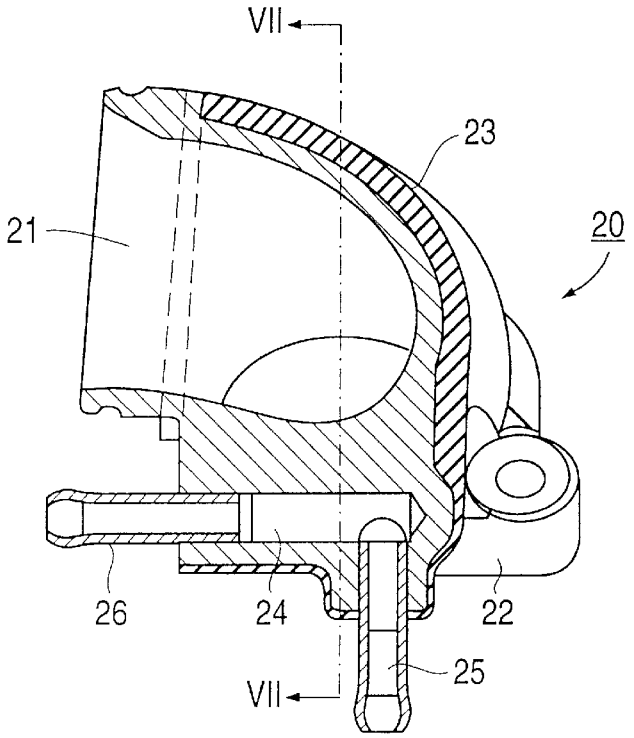
FIG. 6 is a cross-sectional view taken on line VI—VI in FIG. 4.
Figure 7:
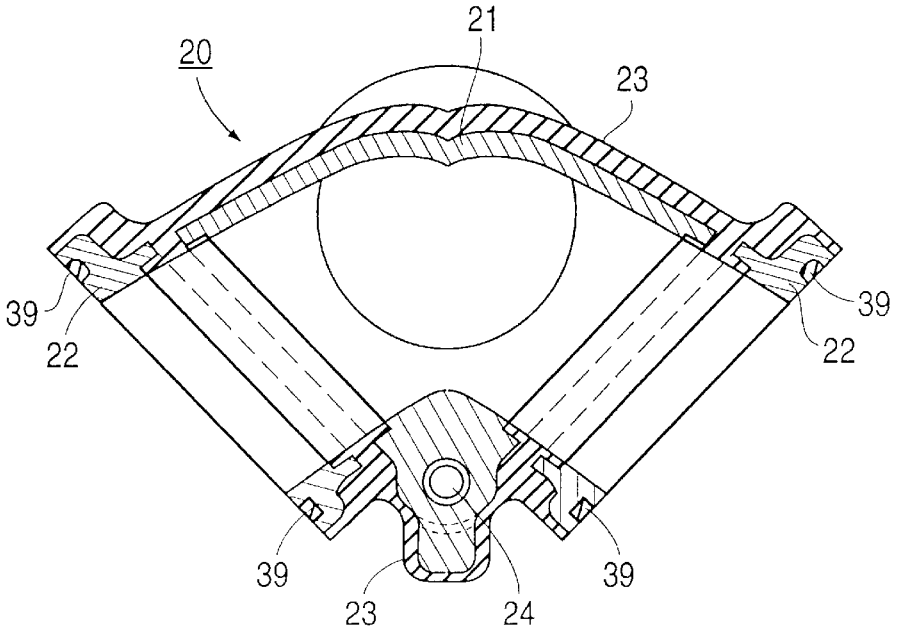
FIG. 7 is a longitudinal sectional view taken on line VII—VII in FIG. 6.
Figure 8:
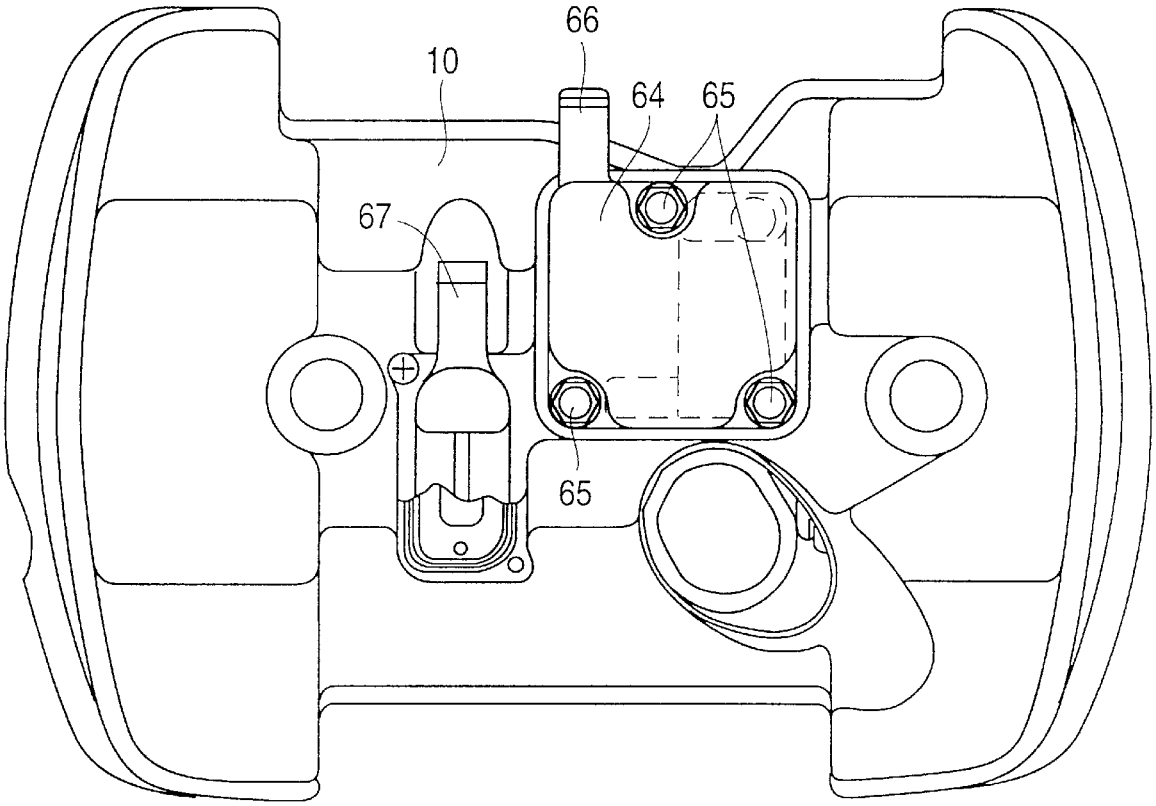
FIG. 8 is a plan view of a cylinder head in the internal combustion engine shown in FIG. 1.

As shown in FIG. 3, the intake pipe 20 includes an intake pipe body 21 made of aluminum and connected to an outlet portion 28 of a carburetor 27. Intake pipe mounting flanges 22 are made of aluminum and abut with intake inlets of intake ports 15 formed in front and rear cylinder heads 9*f*, 9*r*, and a coating member 23 made of rubber for combining the aluminum intake pipe body 21 and the aluminum intake pipe mounting flanges 22 with each other in an airtight and integral manner. The intake pipe body 21 and the two intake pipe mounting flanges 22 are formed as separate members and are fitted into a mold. Crude rubber is charged into a clearance of the mold, followed by vulcanization under heating and pressure, to produce the intake pipe 20.

A cooling water passage 24 is formed in the aluminum intake pipe body 21, and a cooling water inlet joint is fitted in an opening formed in the lower end of the intake pipe body 21. An opening is formed in the carburetor 27 side end portion of the intake pipe body 21 and is fitted with a cooling water outlet joint 26. Further, on the abutment face of each intake pipe mounting flange 22 for abutment with the cylinder heads 9*f* and 9*r* is formed an annular groove throughout the whole circumference of the abutment face. Packing material 39 is fitted in the annular groove.

At the lower portion of the crank case 7 on the left-hand side of the vehicle body, as shown in FIG. 1, there is disposed a cooling water pump 41 which is rotated by the crank shaft 14. A cooling water supply pipe 42 is connected to a discharge port of the cooling water pump 41. The upper end of the cooling water supply pipe 42 is connected to a cooling water passage 43*f* formed in the front lower portion of the front cylinder 8*f*.

Figure 10:
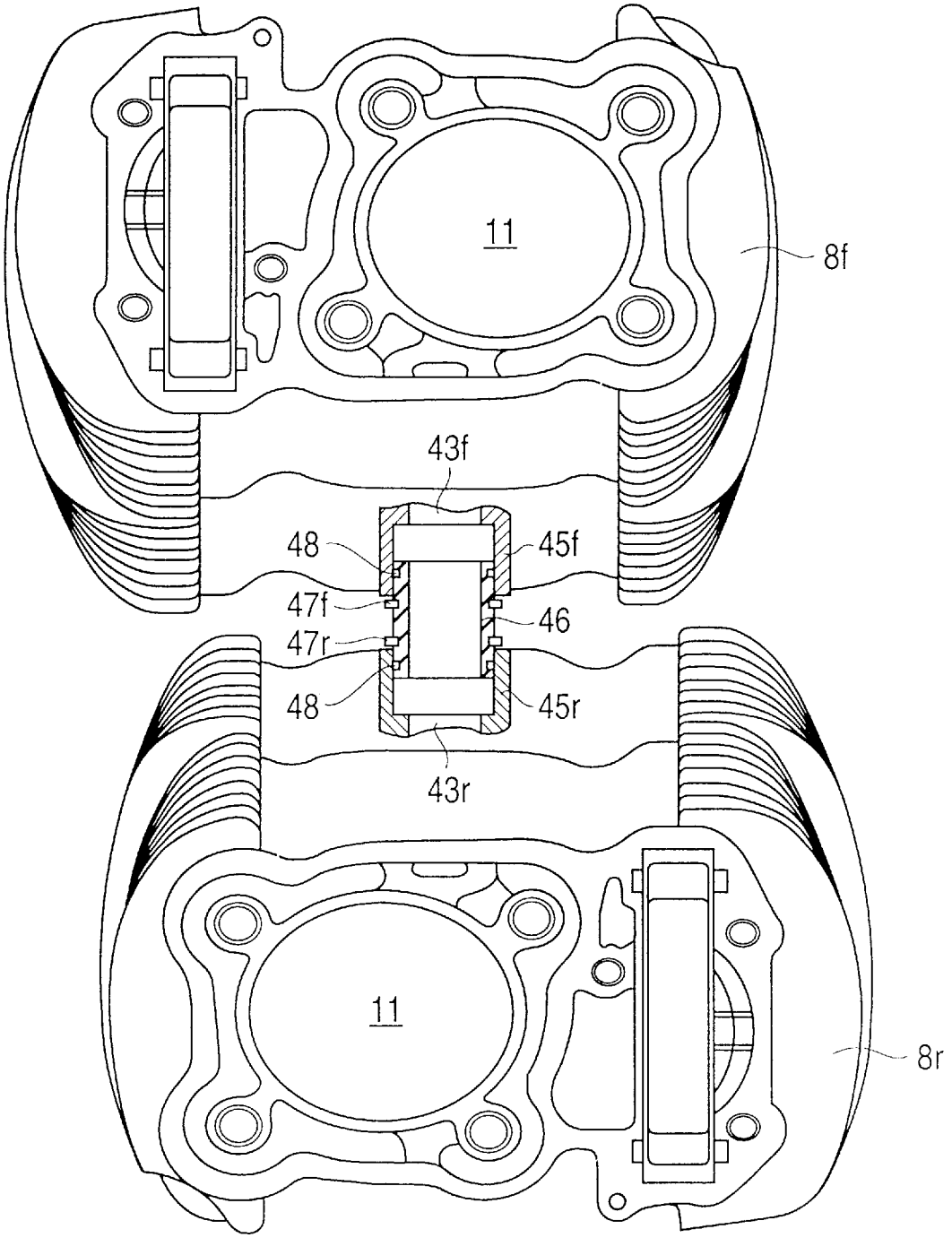
FIG. 10 is a plan view similar to FIG. 3, showing water pipes and a connecting pipe in longitudinal section.

The front cooling water passage 43*f* of the front cylinder 8*f* and a front cooling water passage 44*f* formed in the front cylinder heads 9*f* and 9*r* are in communication with each other. Likewise, a rear cooling water passage 43*r* formed in the rear cylinder 8*r* and a rear cooling water passage 44*r* formed in the rear cylinder head 9*r* are also in communication with each other. As shown in FIG. 10, water pipes 45*f* and 45*r* project in a longitudinally aligned relation to each other at positions where the front and rear cylinders 8*f*, 8*r* are opposed to each other. A connecting pipe 46 is made of rubber and is inserted into the water pipes 45*f* and 45*r*. Further, at front end positions of the water pipes 45*f* and 45*r*, ring-like clips 47*f* and 47*r* are fitted in recesses formed in the outer periphery of the connecting pipe 46. At positions close to the base ends of the water pipes, O-rings 48 are fitted on the connecting pipe. Thus, the water pipes 45*f* and 45*r* are connected with each other in a water tight manner.

As shown in FIG. 1, moreover, cooling water pipes 49*f* and 49*r* communicating with the cooling water passages 44*f* and 44*r*, respectively, and are fitted in the tops of the cylinder heads 9*f* and 9*r*. The cooling water pipe 49*f* and a thermostat 50 are connected with each other through a rubber hose 51. The cooling water pipe 49*r* and the thermostat 50 are connected together through a rubber hose 52. Further, an upper tank 54 of a radiator 53 is disposed along the down tube 3 and the thermostat 50 and is connected together through a rubber hose 56. A lower tank 55 of the radiator 53 and a suction portion of the cooling water pump 41 are connected together through a rubber hose 57. When the water temperature is below a predetermined temperature, a valve of the thermostat 50 is closed to stop the discharge of cooling water to the upper tank 54 of the radiator 53 through the rubber hose 56.

Figure 2:
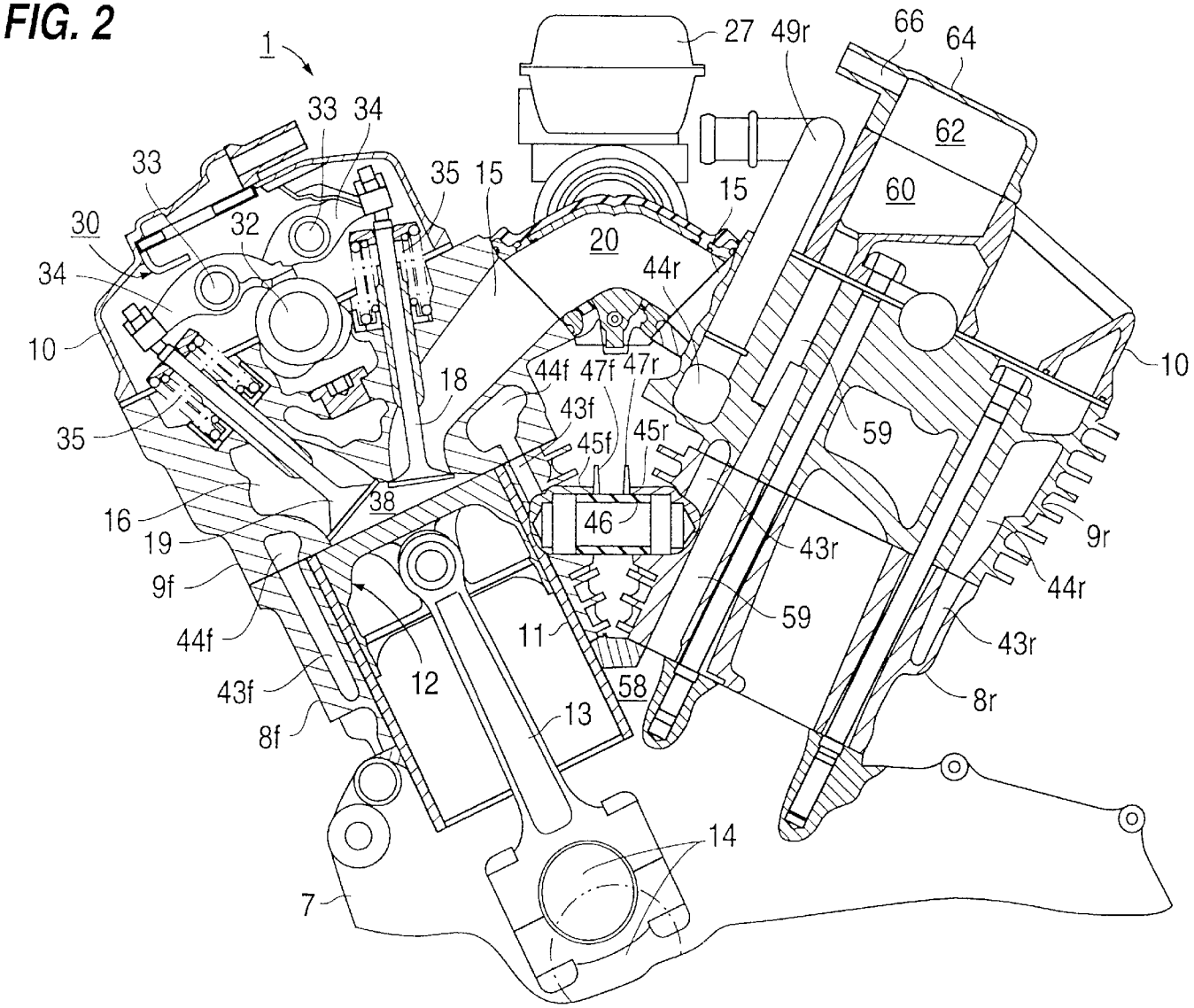
FIG. 2 is a longitudinal sectional side view showing a principal portion of the internal combustion engine illustrated in FIG. 1.
Figure 9:
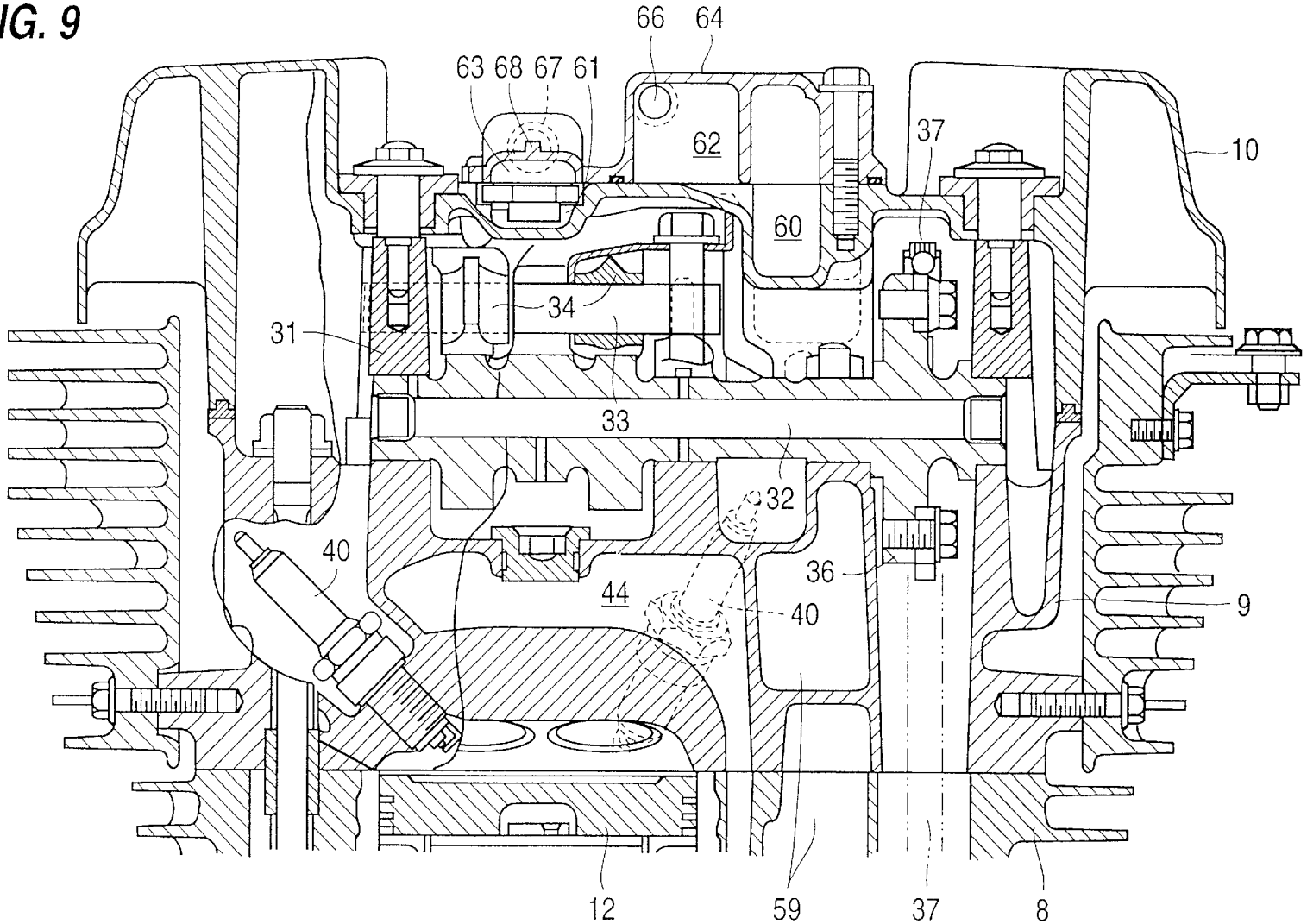
FIG. 9 is a longitudinal sectional view of FIG. 8.

In the head cover 10, as shown in FIGS. 2 and 9, there are formed a lower breather recess 60 communicating with a crank chamber 58 in the crank case 7 through a breather passage 59 and a lower secondary air recess 61 communicating with the exhaust port 16 in the cylinder heads 9*f* and 9*r* through a secondary air passage (not shown). On the other hand, an upper breather recess 62 and an upper secondary air recess 63 in an opposed relation to the lower breather recess 60 and the lower secondary air recess 61, respectively, are formed in a cover member 64. The cover member 64 is integrally fixed to the head cover 10 with bolts 65. The lower and upper breather recesses 60, 62 and the lower and upper secondary air recesses 61, 63 form a breather chamber and a secondary air chamber, respectively. Joints 66 and 67 are fitted in the upper breather recess 62 and the upper secondary air recess 63, respectively, and are connected to an air cleaner (connected upstream of the carburetor 27 though not shown) through a rubber hose (not shown). A reed valve 68 which only permits the passage of secondary air to the lower secondary air recess 61 from the upper secondary air recess 63 is disposed in the joint portion between the lower secondary air recess 61 and the upper secondary air recess 63.

Since the embodiment illustrated in FIGS. 1 to 10 are constructed as above, when the overhead valve type, longitudinally V-shaped, two-cylinder, internal combustion engine 1 is in operation, intake air is filtered by means of an air cleaner (not shown). Thereafter fuel is fed by means of the carburetor 27 and is mixed with the intake air at a required air-fuel ratio, then the mixture passes through the intake pipe 20 and flows into the intake port 15 in the cylinder heads 9*f* and 9*r*. Then when the intake valve 18 is opened in the suction stroke, the mixture is sucked into a combustion chamber 38 formed in the upper portion of the cylinder bore 11.

Thereafter, near the final stage of the compression stroke, the mixture in the combustion chamber 38 is ignited by the spark plug 40, and the exhaust valve 19 is opened in the exhaust stroke which follows the expansion stroke, whereby combustion gas is discharged through an exhaust pipe and a muffler (neither shown).

In this operating condition, even if a throttle valve (not shown) is throttled to increase the negative intake pressure, since the outer periphery of the aluminum body 21 of the intake pipe 20 and the intake pipe mounting flange 22 are made of aluminum and the connection of the two are coated with the coating member 23 made of rubber, the coating member 23 is pressed strongly against both intake pipe body 21 and intake pipe mounting flange 22 due to a pressure difference between the atmospheric pressure and the negative intake pressure. Besides, the coating member 23 made of rubber is present on the outer periphery of the connection between the intake pipe body 21 and the intake pipe mounting flange 22. Therefore, airtightness is ensured firmly and the entry of atmospheric air into the intake pipe 20 is prevented.

Moreover, since the greater part of the intake pipe 20 is constituted by both a highly rigid intake pipe body 21 made of aluminum and an intake pipe mounting flange 22 also made of aluminum, even if such a pressure difference between the atmospheric pressure and the negative intake pressure as mentioned above is exerted on the intake pipe 20, the intake passage shape in the intake pipe 20 does not change and can be maintained in its original shape. As a result, the air-fuel mixture is fed uniformly into front and rear combustion chambers 38*f*, 38*r* without causing disturbance. Thus, a uniform operating condition is ensured by both front and rear cylinders 8*f*, 8*r*.

Since the front and rear cylinders 8*f*, 8*r* are mounted separately to the crank case 7, each of the cylinders 8*f* and 8*r* vibrates independently. Even if the distance between open ends of intake ports 15*f* and 15*r* in the cylinders 8*f* and 8*r* varies, this variation of the distance is absorbed by the coating member 23 made of rubber of the intake pipe 20, and the vibrations of the cylinders 8*f* and 8*r* are also suppressed.

Further, since the intake pipe body 21 connected integrally with the carburetor 27 is in an intervened state between both intake pipe mounting flanges 22, vibrations of the cylinders 8*f* and 8*r* in the overhead valve type, longitudinally V-shaped, two-cylinder, internal combustion engine 1 are also absorbed by the intake pipe mounting flanges 22. Thus, the transfer of vibrations from the cylinders 8*f* and 8*r* to the carburetor 27 is suppressed, whereby not only the carburetor 27 can operate normally without being affected by the vibrations but also improved durability can be attained.

When the cooling water temperature rises and the valve of the thermostat 50 is opened, the cooling water discharged from the cooling water pump 41 is fed to the cooling water passage 43*f* in the front cylinder 8*f* through the cooling water supply pipe 42. A portion of the cooling water flowing through the cooling water passage 43*f* passes through the front cooling water passage 44*f* in the front cylinder head 9*f* and reaches the thermostat 50 through the front cooling water pipe 49*f* and the rubber hose 51. The remaining portion of the cooling water flowing through the front cooling water passage 43*f* flows into the cooling water passage 43*r* in the rear cylinder 8*r* through both connection pipe 46 and rear water pipe 45*r*. The cooling water then passes through the cooling water passage 44*r* in the rear cylinder head 9*r* and reaches the thermostat 50 through both rear cooling water pipe 49*r* and rubber hose 52. Both cooling water portions join together in the thermostat 50. The joined cooling water flows into the upper tank 54 of the radiator 53 through the rubber hose 56 and then flows into the lower tank 55 through a tube (not shown) of the radiator 53 while it is cooled with cooling air and is returned to the suction port of the cooling water pump 41 from the lower tank 55 through the rubber hose 57.

Blow-by gas present in the crank chamber 58 of the crank case 7 flows through the breather passage 59 into the breather chamber formed by both lower breather recess 60 and upper breather recess 62. The blow-by gas is then is conducted to the air cleaner through both joint 66 and a rubber hose (not shown). Further, the air present within the air cleaner flows into the upper secondary air recess 63 through both a rubber hose (not shown) and joint 67. This air is then conducted to the lower secondary air recess 61 through the reed valve 68 and is fed as secondary air to the exhaust port 16 through a secondary air passage (not shown).

The lower and upper breather recesses 60, 62 are formed in the head cover 10, while the lower and upper secondary air recesses 61, 63 are formed in the cover member 64. By merely combining the cover member 64 with the head cover 10 integrally using bolts 65 both breather chamber and secondary air chamber are formed. Therefore, the number of components and the required steps for assembly are decreased and thus a reduction in cost can be attained.

Although in the embodiment illustrated in FIGS. 1 to 10 both upper breather recess 62 and upper secondary air recess 63 are formed in a single cover member 64, the cover member may be divided into two cover members and the recesses 62 and 63 may be formed respectively in the thus divided cover members.

Figure 11:
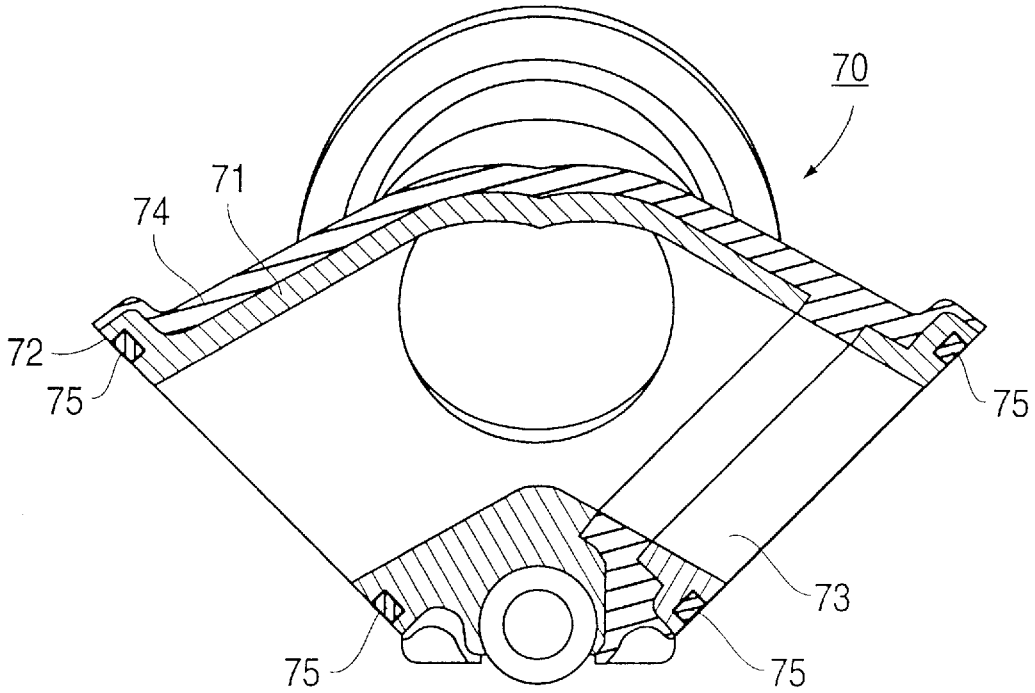
FIG. 11 is a longitudinal sectional view showing another embodiment of the present invention.

Although in the embodiment illustrated in FIGS. 1 to 10, the intake pipe 20 is composed of a single intake pipe body 21 made of aluminum, two intake pipe mounting flanges 22 made of aluminum, and a coating member made of rubber which coats both intake pipe body 21 and flange 22 may be constructed according to the present invention as illustrated in FIG. 11.

In an intake pipe 70 shown in FIG. 11, an intake pipe body 71 made of aluminum is designed to be connected to an intake outlet of the carburetor 27 and an intake pipe mounting flange 72 made of aluminum abuts with the intake inlet of the intake port 15*f* in the front cylinder head 9*f* are formed integrally with each other and are brought into abutment with the intake inlet of the intake port 15*r* in the rear cylinder head 9*r*. An intake pipe mounting flange 73 made of aluminum is formed separately from the intake pipe body 71 and the intake pipe mounting flange 72. The intake pipe body 71 and the intake pipe mounting flanges 72 and 73 are combined together in an integral and airtight manner using a coating member 74 made of rubber which covers the outer peripheral surface of the intake pipe body 71. Packing 75 is fitted in each of the abutting end faces of the intake pipe mounting flanges 72 and 73.

In the intake pipe 70 illustrated in FIG. 11, since the front and rear intake pipe mounting flanges 72 and 73 made of aluminum are combined together through the coating member 74 made of rubber, there does not occur any interference caused by mutual vibrations transferred between the front cylinder 8*f*, cylinder head 9*f* and the rear cylinder 8*r*, cylinder head 9*r*. Consequently, excessive vibrations are prevented from being exerted on the carburetor 27 and hence the carburetor 27 is prevented from being impaired its function and durability.

Since the intake pipe body 71 and the intake pipe mounting flange 72 are rendered integral with each other, the number of components required is decreased and it becomes possible to attain a reduction in the cost of manufacture.

Although in the above embodiments the present invention has been applied to a V-shaped internal combustion engine, it goes without saying that the invention is also applicable to a straight multi-cylinder internal combustion engine or a single-cylinder internal combustion engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake pipe for an internal combustion engine with a carburetor, said intake pipe providing a connection between an intake outlet of the carburetor and an intake inlet of an intake port in the internal combustion engine, comprising:

a metallic intake pipe body connected to the intake outlet of the carburetor;

a metallic intake pipe mounting flange positioned in abutment with the intake inlet of the intake port in the internal combustion engine;

said metallic intake pipe body and said metallic intake pipe mounting flange being separate members; and an elastic member for covering an outer peripheral surface of the metallic intake pipe body for combining the metallic intake pipe mounting flange and said metallic intake pipe body together in an airtight and integral manner.

2. An intake pipe for an internal combustion engine with a carburetor having an intake pipe connected between an intake outlet of the carburetor and an intake inlet of an intake port in the internal combustion engine, comprising:

a multi-cylinder internal combustion engine including a plurality of cylinders;

a metallic intake pipe body connected to the intake outlet of the carburetor, said metallic intake pipe body including an integral type metallic intake pipe mounting flange abutting with an intake inlet of an intake port of any one of the plurality of cylinders, a separate type metallic intake pipe mounting flange for abutting with an intake inlet of an intake port of any other of the plurality of cylinders other than the cylinder connected to the integral type metallic intake pipe mounting flanges;

said mettalic intake pipe mounting flange and said metallic intake pipe body being separate members; and an elastic member for covering an outer peripheral surface of the metallic intake pipe body and said separate metallic intake pipe mounting flange for combining said metallic intake pipe body and said separate metallic intake pipe mounting flange together in an airtight and integral manner.

3. The intake pipe for an internal combustion engine with a carburetor according to claim 2, wherein said multicylinder internal combustion engine is a V-shaped internal combustion engine.

4. The intake pipe for an internal combustion engine with a carburetor according to claim 1, wherein a hot water passage is formed within said metallic intake pipe body.

5. The intake pipe for an internal combustion engine with a carburetor according to claim 2, wherein a hot water passage is formed within said metallic intake pipe body.

6. The intake pipe for an internal combustion engine with a carburetor according to claim 3, wherein a hot water passage is formed within said metallic intake pipe body.

7. The intake pipe for an internal combustion engine with a carburetor according to claim 1, wherein a sealing member is provided on an abutment face of said metallic intake pipe mounting flange for abutment with the internal combustion engine, said sealing member being provided throughout the whole circumference of said abutment face.

8. The intake pipe for an internal combustion engine with a carburetor according to claim 2, wherein a sealing member is provided on an abutment face of said metallic intake pipe mounting flange for abutment with the internal combustion engine, said sealing member being provided throughout the whole circumference of said abutment face.

9. The intake pipe for an internal combustion engine with a carburetor according to claim 3, wherein a sealing member is provided on an abutment face of said metallic intake pipe mounting flange for abutment with the internal combustion engine, said sealing member being provided throughout the whole circumference of said abutment face.

10. The intake pipe for an internal combustion engine with a carburetor according to claim 4, wherein a sealing member is provided on an abutment face of said metallic intake pipe mounting flange for abutment with the internal combustion engine, said sealing member being provided throughout the whole circumference of said abutment face.

* * * * *